US011255025B2

(12) United States Patent
Hahm et al.

(10) Patent No.: US 11,255,025 B2
(45) Date of Patent: Feb. 22, 2022

(54) SPINNING NOZZLE APPARATUS FOR MANUFACTURING HIGH-STRENGTH FIBER

(71) Applicant: KOREA INSTITUTE OF INDUSTRIAL TECHNOLOGY, Cheonan-si (KR)

(72) Inventors: Wan Gyu Hahm, Suwon-si (KR); In Woo Nam, Namyangju-si (KR); Seung Jin Lee, Ansan-si (KR); Ki Sub Lim, Incheon (KR)

(73) Assignee: KOREA INSTITUTE OF INDUSTRIAL TECHNOLOGY, Chungcheongnam-do (KR)

( * ) Notice: Subject to any disclaimer, the term of this patent is extended or adjusted under 35 U.S.C. 154(b) by 642 days.

(21) Appl. No.: 16/098,442

(22) PCT Filed: Apr. 24, 2017

(86) PCT No.: PCT/KR2017/004337
§ 371 (c)(1),
(2) Date: Nov. 2, 2018

(87) PCT Pub. No.: WO2017/191916
PCT Pub. Date: Nov. 9, 2017

(65) Prior Publication Data

US 2021/0238768 A1 Aug. 5, 2021

(30) Foreign Application Priority Data

May 2, 2016 (KR) ..... 10-2016-0054007

(51) Int. Cl.

| | |
|---|---|
| ***D01D 4/02*** | (2006.01) |
| ***D01D 5/084*** | (2006.01) |
| ***D01D 10/02*** | (2006.01) |

(52) U.S. Cl.
CPC ..... *D01D 4/02* (2013.01); *D01D 5/084* (2013.01); *D01D 10/02* (2013.01); *D10B 2401/063* (2013.01)

(58) Field of Classification Search
CPC ..... D01D 4/02; D01D 4/08; D01D 5/084
See application file for complete search history.

(56) References Cited

U.S. PATENT DOCUMENTS 3,006,028 A * 10/1961 Calhoun ..... B29C 48/05 425/463
5,705,119 A * 1/1998 Takeuchi ..... D01D 5/08 264/464

FOREIGN PATENT DOCUMENTS

JP 2003342826 A 12/2003
JP 2014534357 A 12/2014
(Continued)

OTHER PUBLICATIONS

JP 2003342826 machine translation (Year: 2003).*
(Continued)

*Primary Examiner* — Timothy Kennedy
*Assistant Examiner* — Alexander A Wang
(74) *Attorney, Agent, or Firm* — Cantor Colburn LLP

(57) ABSTRACT

The present invention relates to a spinning nozzle apparatus for manufacturing a high-strength fiber.
The spinning nozzle apparatus for manufacturing a high-strength fiber according to the present invention is designed to optimize a heating method for the spinning region of a spinning nozzle in the melt spinning process. The heat transfer method is optimized by disposing the spinning nozzle holes of spinning nozzle commercially available on the outside of, directly under the pack body and heating the spinning nozzle holes with a heating body. In addition, an instantaneous heat treatment at high temperature is adopted to control the molecular entanglement structure in the
(Continued)

melted polymer, which enhances the drawability of the thermoplastic resin and hence improves the mechanical properties such as strength and elongation.

4 Claims, 10 Drawing Sheets

(56) References Cited

FOREIGN PATENT DOCUMENTS

| | | |
|---|---|---|
| KR | 100199471 B1 | 6/1999 |
| KR | 101171820 B1 | 8/2012 |
| KR | 101632636 B1 | 6/2016 |

OTHER PUBLICATIONS

International Search Report dated Aug. 22, 2017 for PCT/KR2017/004337.

M. Masuda et al., "Effect of the Control of Polymer Flow in the Vicinity of Spinning Nozzle on Mechanical Properties of Poly(ethylene terephthalate) Fibers", Intern. Polymer Processing XXV, 2010, pp. 159-169.

M. Sugimoto et al., "Melt Rheology of Polypropylene Containing Small Amounts of High-Molecular-Weight Chain. 2. Uniaxial and Biaxial Extensional Flow", Macromolecules, 2001, pp. 6056-6063, vol. 34, No. 17, American Chemical Society.

Masayoshi Ito et al., "Effects of sample geometry and draw conditions on the mechanical properties of drawn poly (ethylene terephthalate)", Polymer, Jan. 1990, pp. 58-63, vol. 31.

Ziabicki, "Effects of Molecular Weight on Melt Spinning and Mechanical Properties of High-Performance Poly (ethylene Terephthalate) Fibers", Textile Research Journal, Nov. 1996, pp. 705-712.

* cited by examiner

SPINNING NOZZLE APPARATUS FOR MANUFACTURING HIGH-STRENGTH FIBER

TECHNICAL FIELD

The present invention relates to a spinning nozzle device for manufacturing a high-strength fiber, and more particularly to a spinning nozzle device for manufacturing a high-strength fiber that optimizes the heating method for the spinning region in the process of melt-spinning a thermoplastic resin through spinning nozzles to heat up the melted fiber coming out of the spinning nozzles to a temperature above the temperature of the pack body during a short period of time without occurrence of thermal degradation, so it is possible to control the molecular entanglement structure in the melted polymer of the thermoplastic resin without deterioration of the molecular weight caused by an instantaneous heat treatment at high temperature, resulting in the enhanced drawability of the fiber and hence the improved mechanical properties such as strengths and elongation, to reduce the melt viscosity (nozzle shear pressure) of the fiber during the spinning process while utilizing the existing processes for melt spinning and drawing, allowing the spinning of a high-viscosity resin, and to lower the cooling rate of the fiber to reduce the spinning tension (orientation), additionally improving the spinning speed (production rate) and thus realizing a large-quality production of high-strength fibers at a low cost.

BACKGROUND ART

As for the PET (Polyethylene terephthalate) fibers commercially available, the reported maximum strength is about 1.1 GPa and the practical maximum strength is no more than 3 to 4% of the theoretical strength and only a third of other high-strength fibers' (e.g., about 2.9 GPa of ultimate performance para-aramid (Kevlar) fibers). Hence, there is a limit to the application of the PET fibers to the industrial textile materials requiring ultimate performances other than general clothing or some household or industrial fiber materials (e.g., tire cord).

As mentioned above, compared to liquid crystal polymers (LCP) like PBO (poly(p-phenylene-2,6-benzobisoxazole, Zylon) and para-aramid (Kevlar) fibers, non-LCP thermoplastic polymer fibers such as PET and nylon fibers display lower strength and have no ultimate increase in their actual strength with respect to the theoretical value. This results from the difference of behaviors in the formation of structures when the resin is processed into fibers.

That is, the liquid crystal polymers (LCP) are capable of forming a structure of liquid crystals while in the liquid phase. Under a proper shear stress, they have just a small difference in entropy of the fiber structure before and after spinning and form a fiber structure having a considerably high degree of orientation and crystallinity, realizing a production of high-strength, high-performance fibers.

By the contrast, non-LCP thermoplastic polymers such as PET and nylon fibers have a complicated structure with polymer chains entangled in the form of non-crystalline random coils in the liquid phase. Hence, even under high shear stress at the spinning nozzles and then with high draw ratio (e.g., draft and drawing ratio), they are relatively hard of having a complete orientation-induced crystallization (i.e., high strength) due to the entangled random-coil structure, resulting in a large difference in the entropy of the fiber structure before and after the spinning process.

Despite the structural disadvantages of the general thermoplastic polymers, the development of thermoplastic polymers with higher strength may expand the market for the applications of thermoplastic polymers and bring about a great ripple effect. Therefore, many studies have recently been made on the methods of maximizing the properties and increasing the critical performances of the general PET fibers as led by the Japanese textile industry.

For example, there are reported studies on the manufacture of a high-strength fiber using an ultrahigh-high-molecular-weight PET resin [Ziabicki, A., "Effect of Molecular Weight on Melt Spinning and Mechanical Properties of High-Performance Poly(ethylene terephthalate) Fibers", Text. Res. J., 1996, 66, 705-712; Sugimoto, M., et al., "Melt Rheology of Polypropylene Containing Small Amounts of High-Molecular-Weight Chain. 2. Uniaxial and Biaxial Extensional Flow", Macromol, 2001, 34, 6056-6063], and the maximization of orientation using a coagulation bath technique to the melt spinning [Ito M., et al., "Effect of Sample Geometry and Draw Conditions on the Mechanical Properties of Drawn Poly(ethylene terephthalate)", Polymer, 1990, 31, 58-63].

However, those studies are not available in the practical uses due to their limits in the workability and productivity with respect to the effect of enhancing the properties of fibers in consideration of the laboratory-scaled approach to the development of high-strength PET fibers.

In Japan, there has recently been a study on the approach to enhancing the strength of the existing fibers from 1.1 GPa to 2 GPa using a general thermoplastic polymer such as PET or nylon based on the melt spinning process without raising the production cost twofold or more.

Furthermore, the fields under research and development for the purpose of being applied to the tire cords most consumed as an industrial fiber and put into practical use are the melted structure control technology, the molecular weight control technology, the drawing/annealing technology, and evaluation/analysis technology.

Particularly, the melted structure control technology is an approach to the conception of controlling the molecular entanglement structure in the melted polymer and identifying the structure control and behavior in non-oriented amorphous fibers to realize the high strength of the PET fibers, rather than to the conception of controlling the behavior of forming a fiber structure through the molecular orientation and crystallization of the existing solidified fibers to impart high strength to the fibers.

Accordingly, there is a study on the manufacture of high-strength PET fibers using the design of a spinning nozzle device, a laser heating, a supercritical gas, a coagulation bath, etc. as a means for controlling the molecular structure in the melt spinning process.

In particular, an example of the conventional spinning nozzle design for the melt spinning process is a technique for applying a local heating in the vicinity of the spinning nozzle in the production of high-strength PET fibers, which is a local heating method that involves applying a heat directly from under the spinning nozzle as shown in FIG. 7.

More specifically, the spinning nozzle apparatus used for the melt spinning process includes a pack-body heater 300 with a heat source having a temperature of 100 to 350° C., a pack body 200 held to the pack-body heater 200, a spinning nozzle 100 fixed to the pack body 200, and a lower plate 500 and a retainer 600 sequentially installed on the top of the spinning nozzle 100. The melted thermoplastic resin is fed into the spinning nozzle 100 through the retainer 600 and the lower plate and spun through spinning nozzle holes 111 of the spinning nozzle 100.

The fiber 112 formed after the spinning process is passed through a 20-200 mm annealing heater 400 that is an electric heater for applying a heat in the temperature range from room temperature to 400° C. to the fiber uniformly from a constant distance, which realizes a high-efficiency heat transfer at a lower cost.

But, the local heating method for the fiber 112 with the annealing heater 400 is not for heating the fiber but for warming the fiber to maintain the uniform temperature of the spinning nozzle holes 111 at the lower part of the spinning nozzle 100, minimizing the temperature deviation of the spinning nozzle holes 111, so it is effective only to improve the spinning workability and quality rather than to uniformly apply a heat to the fiber 112 as the fiber 112 is far apart from the annealing heater 400.

Another conventional spinning nozzle apparatus for a local heating in the vicinity of the spinning nozzle in the melt spinning process involves irradiating a $CO_2$ laser beam directly from under the spinning nozzle with the spinning orifice having a micronized diameter to produce a high-performance PET fiber with the post-drawing strength of 1.68 GPa (13.7 g/den) and elongation of 9.1% [Masuda, M., "Effect of the Control of Polymer Flow in the Vicinity of Spinning Nozzle on Mechanical Properties of Poly(ethylene terephthalate) Fibers", Intern. Polymer Processing, 2010, 25, 159-169].

In this regard, FIG. 8 shows a mode of carrying out a local heating with a laser beam irradiated directly from under a spinning nozzle. More specifically, a fiber 112 formed after a spinning process is directly heated with a $CO_2$ laser beam irradiated from a $CO_2$ laser irradiator 410 in a design of the spinning nozzle apparatus that the bottom portion of a spinning nozzle projects to a length of 0 to 3 mm from the bottom of a pack body 200 so that a $CO_2$ laser beam is irradiated from a distance of 1 to 10 mm immediately after the spinning process.

The laser-based heating directly from under the spinning nozzle 100 may have an effect of heating a specific region of the fiber 112, but with the difficulty of being applied to the practical spinning nozzle 10 that has scores to scores of thousands of spinning nozzle holes 111.

In an attempt to improve the problems with the conventional method of applying a local heating directly from under a spinning nozzle in the process of manufacturing of a high-strength fiber, the inventors of the present invention have found it out that a heat transfer method can be optimized by locally applying a heat in the vicinity of the spinning nozzle holes of a practical spinning nozzle to heat up the melted fiber coming out of the spinning nozzles to a temperature above the temperature of the pack body during a short period of time without occurrence of thermal degradation, so it is possible to control the molecular entanglement structure in the melted polymer of the thermoplastic resin without deterioration of the molecular weight caused by an instantaneous heat treatment at high temperature, resulting in the enhanced drawability of the fiber and hence the improved mechanical properties like strengths and elongation, to reduce the melt viscosity (nozzle shear pressure) of the fiber during the spinning process while utilizing the existing processes for melt spinning and drawing, allowing the spinning of a high-viscosity resin, and to lower the cooling rate of the fiber to reduce the spinning tension (orientation), additionally improving the spinning speed (production rate) and thus realizing a large-quality production of high-strength fibers at a low cost, thereby completing the present invention.

DISCLOSURE

Technical Problem

It is an object of the present invention to provide a spinning nozzle apparatus for manufacturing a high-strength fiber that uses the spinning orifice of a spinning nozzle disposed on the outside of a pack body in the melt spinning process of a thermoplastic resin and provides an optimized heating method for the spinning orifice.

Technical Solution

In accordance with a first preferred embodiment of the present invention, there is provided a spinning nozzle apparatus for manufacturing a high-strength fiber that includes: a pack body 21; a pack body heater 22 installed on the outside of the pack body to provide a heat source for the pack body; a spinning nozzle 23 installed in the pack body 21 to spin a melted thermoplastic resin; and a retainer 24 and a lower plate 25 installed in the pack body to feed the melted thermoplastic resin into the spinning nozzle. The spinning nozzle 23 includes a fixation member 23*b* disposed on the inside of the pack body 21 and a spinning member 23*c* disposed on the outside of the pack body 21. The spinning member 23*c* disposed on the outside of the pack body has a plurality of spinning nozzle holes 23*a* for melt-spinning the thermoplastic resin to form a fiber. The spinning nozzle apparatus further includes a heating body 26 for heating the portion of the spinning nozzle holes 23*a* of the spinning member 23*c* to a temperature above the temperature of the pack body 21.

In the first embodiment of the present invention, the spinning nozzle 23 has an extension member 23*d* for maintaining the spinning member 23*c* apart from the fixation member 23*b*. The extension member 23*d* extends to a length of 10 to 500 mm from the bottom of the pack body 21 to position the spinning nozzle holes 23*a* of the spinning member 23*c*.

In the first embodiment of the present invention, the heating body 26 is installed in a ring form to surround the side wall of the spinning member 23*c*. Preferably, the bottom of the lower plate 25 is inserted in the spinning nozzle 23 and designed to extend to a boundary point between the extension member 23*d* and the spinning member 23*c* of the spinning nozzle 23 to induce the melted thermoplastic resin to an inlet of the spinning nozzle holes 23*a*. The spinning nozzle apparatus further includes a space member 27 between the inner wall of the fixation member 23*b* and the extension member 23*d* and the opposing outer wall of the lower plate 25, and an air passage hole 28 formed in the extension member 23*d* to provide a connection between the space member 27 and the outside.

In accordance with a second preferred embodiment of the present invention, there is provided a spinning nozzle apparatus for manufacturing a high-strength fiber that includes: a pack body 31; a pack body heater 32 installed on the outside of the pack body to provide a heat source for the pack body; a spinning nozzle 33 disposed on the outside of the pack body 31 having a plurality of spinning nozzle holes 33*a* for melt-spinning the thermoplastic resin to form a fiber; and a retainer 34 and a lower plate 35 installed in the pack body to feed a melted thermoplastic resin into a spinning nozzle 33. The lower plate 35 includes a first lower plate 35*a* disposed on the inside of the pack body 31, and a second lower plate 35*b* disposed on the outside of the pack body 31 and designed to be detachable from the first lower plate 35*a*. The spinning nozzle 33 is detachable from the bottom of the second lower plate 35*b* and disposed on the outside of the pack body 31.

The spinning nozzle apparatus further includes a heating body 36 for heating the portion of the spinning nozzle holes 33*a* to a temperature above the temperature of the pack body 31.

In the second embodiment of the present invention, the heating body 36 is installed in a form surrounding the lateral side and topside of the second lower plate 35*b* and the spinning nozzle 33. Preferably, a space member 37 is provided for passage of air between the bottom end of the pack body 31 and the heating body 36.

In accordance with a third preferred embodiment of the present invention, there is provided a spinning nozzle apparatus for manufacturing a high-strength fiber that includes: a pack body 41; a pack body heater 42 installed on the outside of the pack body to provide a heat source for the pack body; a spinning nozzle 43 being installed in the pack body 41 and having a plurality of spinning nozzle holes 43*a* for spinning a melted thermoplastic resin; and a retainer 44 (not shown) and a lower plate 45 (not shown) installed in the pack body to feed the melted thermoplastic resin into the spinning nozzle. The spinning nozzle apparatus further includes: a heating body 46 disposed under the spinning nozzle holes 43*a* of the spinning nozzle to heat up a fiber after a spinning process to a temperature above the temperature of the pack body 41; and an insulating layer 40 disposed between the spinning nozzle 43 and the heating body 46. The heating body 46 has a hole-type heating opening 46*a* or a band-type heating opening 46*b* arranged in a row for the passage of the fiber after the spinning process.

In the third embodiment of the present invention, the insulating layer 40 has a thickness of 1 to 30 mm, and the heating body 46 extending to a length of 1 to 500 mm from the insulating layer 40. Further, a heating region for the fiber is defined by the thickness of the insulating layer 40 and the extension length of the heating body 46.

In accordance with a fourth preferred embodiment of the present invention, there is provided a spinning nozzle apparatus for manufacturing a high-strength fiber that includes: a pack body 51; a pack body heater 52 installed on the outside of the pack body to provide a heat source for the pack body; a spinning nozzle 53 being installed in the pack body 51 and having a plurality of spinning nozzle holes 53*a* for spinning a melted thermoplastic resin; and a retainer 54 (not shown) and a lower plate 55 (not shown) installed in the pack body to feed the melted thermoplastic resin into the spinning nozzle. The spinning nozzle apparatus further includes a heating body 56 disposed in the vicinity of the spinning nozzle holes 53*a* of the spinning nozzle 53 to heat up the vicinity of the spinning nozzle holes 53*a* and a fiber after a spinning process to a temperature above the temperature of the pack body 51. The heating body 56 has a hole-type heating opening 56*a* or a band-type heating opening 56*b* arranged in a row for the passage of the fiber after the spinning process. The heating body 56 is in contact with the bottom of the spinning nozzle 53 or partially inserted in the bottom of the spinning nozzle 53.

In the fourth embodiment of the present invention, the bottom side of the spinning nozzle 53 is disposed at a distance of 1 to 300 mm from the bottom side of the pack body. The heating body 56 being in contact with the bottom side of the spinning nozzle 53 or partially inserted in the bottom of the spinning nozzle 53 to a insertion depth of 0 to 50 mm. The heating body 56 extends from the bottom side of the spinning nozzle 53 to an extension length of 0 to 500 mm. Further, a heating region for the fiber is defined by the insertion depth of the heating body 56 partially inserted in the bottom of the spinning nozzle 53 and the extension length of the heating body 56 from the bottom side of the spinning nozzle.

In the fourth embodiment of the present invention, the topside of the heating body 56 partially inserted in the bottom of the spinning nozzle 53 has a direct contact with or a gap from the facing surface of the spinning nozzle 53 facing the topside of the heating body 56. The insertion depth of the heating body 56 partially inserted in the bottom of the spinning nozzle 53 is defined as 50 mm to the maximum so that the heating body 56 performs a direct heating on the melted thermoplastic resin in the spinning nozzle 53 prior to a spinning process and an indirect heating on the fiber directly from under the nozzle body in a simultaneous manner.

In the third and fourth embodiments of the present invention, the hole- or band-type heating opening is preferably formed to have its inner circumference apart from the center of the spinning nozzle holes within a distance of 1 to 300 mm.

Advantageous Effects

The spinning nozzle apparatus for manufacturing a high-strength fiber according to the present invention with the above-specified characteristic features is designed to optimize a heating method for the spinning region of a spinning nozzle in the melt spinning process. The heat transfer method is optimized by disposing the spinning nozzle holes of spinning nozzle commercially available on the outside of, directly under the pack body and heating the spinning nozzle holes with a heating body. In addition, an instantaneous heat treatment at high temperature is adopted to control the molecular entanglement structure in the melted polymer, which enhances the drawability of the thermoplastic resin and hence improves the mechanical properties such as strength and elongation.

The spinning nozzle apparatus for manufacturing a high-strength fiber according to the present invention makes the use of a heating device that employs the existing processes for melt spinning and drawing but offers a high energy efficiency with a simple structure, to effectively reduce the cooling rate of the fibers during the spinning process and enhance the spinning and drawing rates. This eventually lowers the initial investment cost and enables a large-quantity production of high-performance fibers at a low cost.

The spinning nozzle apparatus for manufacturing a high-strength fiber according to the present invention can also effectively reduce the viscosity of the melted resin in the spinning nozzle holes without deterioration of the molecular weight by adopting a heating device using the existing processes for melt spinning and drawing but offering a high energy efficiency with a simple structure. This increases the use cycle of the spinning nozzle, ensures a spinning process with a spinning nozzle with higher shear rate and higher L/D hole specification to improve the spinning workability and fiber quality, and particularly enables the spinning process for ultrahigh-viscosity resins which has never been realized before, to reduce the initial investment cost and produce high-performance fibers in large quantities at a low cost.

Based on high price competitiveness due to large-quality production and low cost and the control of various fiber properties, the spinning nozzle apparatus of the present invention is usefully available in the production of tire cords, interior materials for transportation including automobile, trains, aircrafts, ships, etc., civil engineering and construction materials, electronic materials, marine and military applications such as ropes and nets, and other clothing and household applications, including light-weighted sportswear and work clothes, military uniforms, furniture and interior materials, sports equipment, or the like, and hence promising market expansion for the wider range of applications.

Besides, the spinning nozzle apparatus of the present invention is applicable not only to the textile applications including PET long and short fibers, unwoven fabrics, etc. but also to the manufacture of films, sheets, molds, containers, or the like using those textile materials.

DESCRIPTION OF REFERENCE NUMBERS AND SYMBOLS

Figure 1:
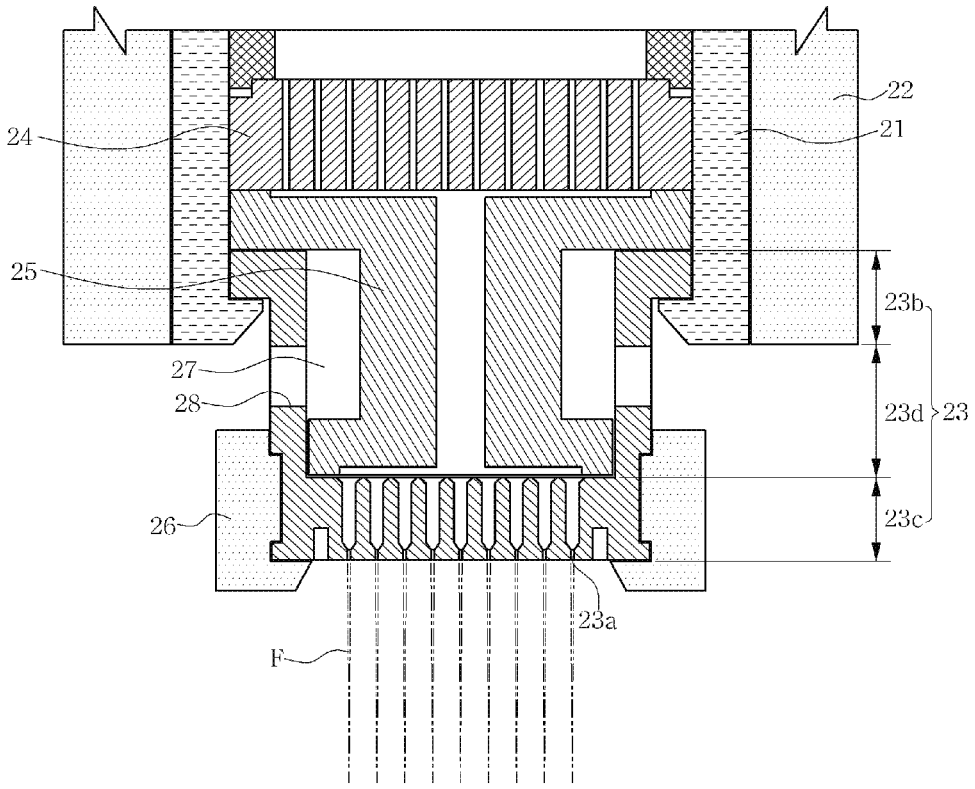
FIG. 1 is a cross-sectional diagram showing a spinning nozzle apparatus for manufacturing a high-strength fiber in accordance with a first embodiment of the present invention.

21, 31, 41, 51: pack body
22, 32, 42, 52: pack body heater
23, 33, 43, 53: spinning nozzle
23*a*, 33*a*, 43*a*, 53*a*: spinning nozzle holes
23*b*: fixation member
23*c*: spinning member
23*d*: extension member
24, 34, 44, 54: retainer
25, 35, 45, 55: lower plate
35*a*, 35*b*: first lower plate, second lower plate
26, 36, 46, 56: heating body
46*a*, 46*b*, 46*c*, 56*a*, 56*b*, 56*c*: heating opening
27, 37: space member
28: air passage hole
38: female screw member
39: male screw member
40: insulating layer
F: fiber

PREFERRED EMBODIMENTS OF THE INVENTION

Hereinafter, the preferred embodiments of the present invention will be described in detail with reference to the accompanying drawings.

FIG. 1 is an illustration of a spinning nozzle apparatus in accordance with a first embodiment of the present invention. As illustrated in the figure, the spinning nozzle apparatus according to the first embodiment of the present invention includes: a pack body 21; a pack body heater 22 installed on the outside of the pack body to provide a heat source for the pack body 21; a spinning nozzle 23 installed in the pack body 21 to spin a melted thermoplastic resin; and a retainer 24 and a lower plate 25 installed in the pack body 21 to feed the melted thermoplastic resin into the spinning nozzle 23.

In the first embodiment of the present invention, the spinning nozzle 23 includes a fixation member 23*b* disposed on the inside of the pack body 21 and a spinning member 23*c* disposed on the outside of the pack body 21. The spinning member 23*c* disposed on the outside of the pack body has a plurality of spinning nozzle holes 23*a* for melt-spinning the thermoplastic resin to form a fiber. The spinning nozzle apparatus further includes a heating body 26 for heating the portion of the spinning nozzle holes 23*a* of the spinning member 23*c* to a temperature above the temperature of the pack body 21.

In the first embodiment of the present invention, the spinning nozzle 23 has an extension member 23*d* for maintaining the spinning member 23*c* apart from the fixation member 23*b*. The extension member 23*d* extends to a length of 10 to 500 mm from the bottom of the pack body 21, so the spinning nozzle holes 23*a* of the spinning member 23*c* are disposed on the outside of the pack body.

Namely, the spinning member 23*c* has a plurality of spinning nozzle holes 23*a* for melt-spinning a thermoplastic resin to form a fiber F. The extension member 23*d* extends to a length of 10 to 500 mm, more preferably 100 to 300 mm from the bottom of the pack body 21 so as to position the spinning member 23*c* and the spinning nozzle holes 23*a* on the outside of the pack body 21.

Further, the spinning member 23*c* of the spinning nozzle 23 has the heating body 26 for heating the portion of the spinning nozzle holes 23*c* disposed on the outside of the pack body 21. The heating body 26 is provided in the form of a ring and installed to surround the sidewall of the spinning member 23*c*.

Preferably, the bottom of the lower plate 25 is inserted in the spinning nozzle 23 and designed to extend to a boundary point between the extension member 23*d* and the spinning member 23*c* of the spinning nozzle 23 to induce the melted thermoplastic resin to an inlet of the spinning nozzle holes 23*a*.

In general, the pack body 21 is maintained at 50 to 350° C. with the pack body heater 22. Undesirably, the temperature of the pack body 21 lower than 50° C. maintains almost the resins hard rather than melted, and the temperature of the pack body 21 above 350° C. causes a rapid thermal degradation of the resin to deteriorate the properties of the fiber. Therefore, it is preferable to maintain the temperature of the spinning member 23*c* of the spinning nozzle 23 heated by the heating body 26 higher than that of the pack body 21. For example, the spinning member 23*c* of the spinning nozzle is preferably maintained in the temperature range of 350 to 700° C. when the temperature of the pack body 21 is 300° C. Accordingly, the heating temperature for the portion of the spinning nozzle holes 23*a* is higher than that for the melted resin in the pack body 21.

It is designed to minimize the heat transfer between the pack body 21 and the spinning nozzle 23. For this, a space member 27 is provided between the inner wall of the fixation member 23*b* and the extension member 23*d* of the spinning nozzle 23 and the opposing outer wall of the lower plate 25, and an air passage hole 28 is formed in the extension member 23*d* of the spinning nozzle 23 to provide a connection between the space member 27 and the outside.

Such a structure not only positions the spinning member 23*c* of the spinning nozzle on the outside of the pack body 21 but also allows the passage of air in the space member 27 between the spinning nozzle 23 and the lower plate 25, preventing a transfer of high heat from the heating body 26 to the pack body 21 through the spinning nozzle 23 and the resulting rise in the temperature of the pack body 21 at once. The elevation of the temperature may cause a deterioration of the raw material consisting of a thermoplastic resin, for example, polyester-based polymer resin in the pack body 21 and hence deteriorate the properties of the fiber product.

According to the spinning nozzle apparatus of the first embodiment, the melted thermoplastic resin induced into the spinning nozzle 23 through the retainer 24 and the lower plate 25 is spun through the spinning nozzle holes 23*a* to form a fiber F. After the spinning process, the fiber F is cooled down and subjected to the drawing and winding processes using a yarn texturing machine to form a high-strength thermoplastic polymer fiber.

In this regard, the heating body 26 instantaneously heats up the spinning member 23*c* of the spinning nozzle 23 exposed to the outside of the pack body 21 to a temperature above the temperature of the pack body 21 by at least 50 to 400° C., achieving a control of the molecular entanglement structure in the melted polymer being spun through the spinning nozzle holes 23*a* to improve the mechanical properties of the thermoplastic polymer fiber such as strength and elongation.

With such a construction that includes the extension member 23*d* designed to position the spinning member 23*c* of the spinning nozzle 23 on the outside of the pack body 21 and allows the passage of the external air in the space member 27 between the spinning nozzle 23 and the lower plate 25, it is possible to minimize the rise of the temperature caused by a heat transfer from the heating body 25 to the inside of the pack body 21 through the spinning nozzle 23 and thus to prevent a deterioration of the properties caused by the deterioration of the melted polymer in the pack body 21.

Figure 2:
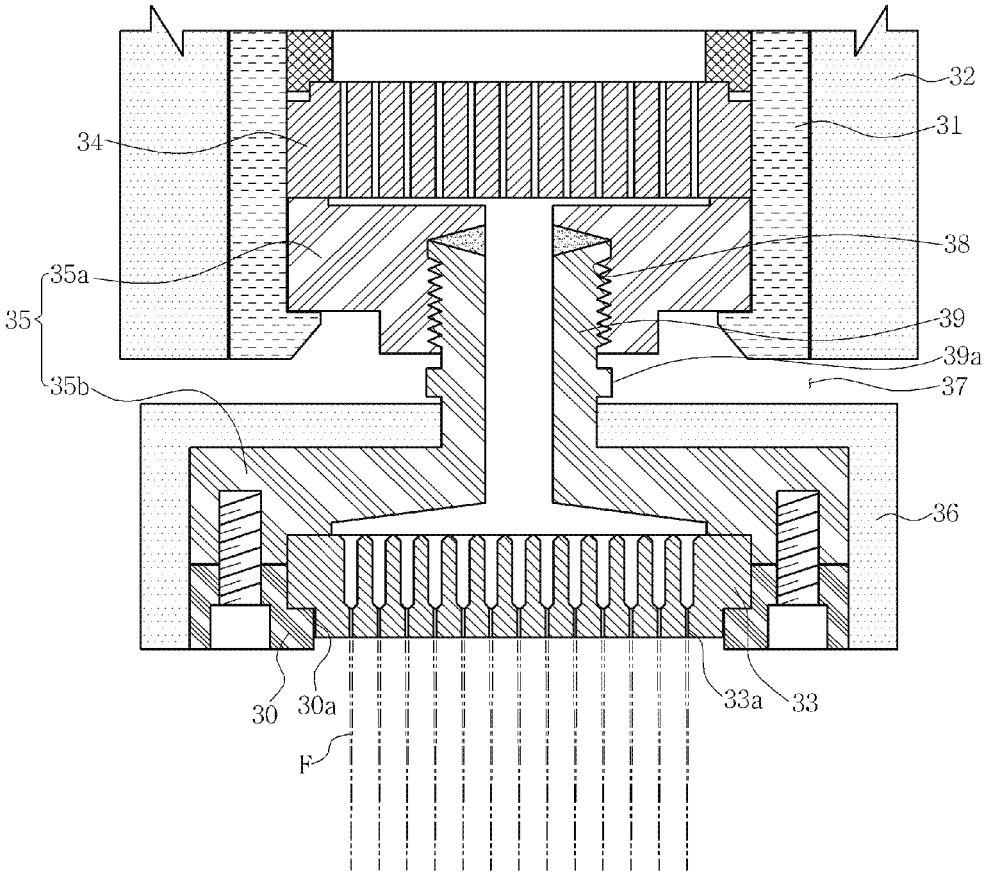
FIG. 2 is a cross-sectional diagram showing a spinning nozzle apparatus for manufacturing a high-strength fiber in accordance with a second embodiment of the present invention.

FIG. 2 is an illustration of a spinning nozzle apparatus in accordance with a second embodiment of the present invention. As illustrated in the figure, the spinning nozzle apparatus according to the second embodiment of the present invention includes: a pack body 31; a pack body heater 32 installed on the outside of the pack body to provide a heat source for the pack body 31; and a retainer 34 and a lower plate 35 installed in the pack body 31 to feed a melted thermoplastic resin into a spinning nozzle 33.

The lower plate 35 includes a first lower plate 35*a* disposed on the inside of the pack body 31, and a second lower plate 35*b* disposed on the outside of the pack body 31 and designed to be detachable from the first lower plate 35*a*. The spinning nozzle 33 is detachable from the bottom of the second lower plate 35*b* and disposed on the outside of the pack body 31. The spinning nozzle 33 disposed on the outside of the pack body 31 has a plurality of spinning nozzle holes 33*a* for melt-spinning the thermoplastic resin to form a fiber F. The spinning nozzle apparatus further includes a heating body 36 for heating the portion of the spinning nozzle holes 33*a* to a temperature above the temperature of the pack body 31.

For the detachable structure of the first and second lower plates 35*a* and 35*b*, the first lower plate 35*a* has a female screw member 38 and the second lower plate 35*b* has a male screw member 39, the male screw member 39 screws into the female screw member 38 to make the second lower plate 35*b* detachable from the first lower plate 35*a*. Preferably, the male screw member 39 of the second lower plate 35*b* has a hexagonal head member 39*a* that makes the rotation of the second lower plate 35*b* easier.

In the detachable structure of the first and second lower plate 35*a* and 35*b*, the top of the spinning nozzle 33 is inserted in the bottom side of the second lower plate 35*b*, and a bottom ring plate 30 being attached to the second lower plate 35*b* by means of the threads of a screw is used to fix the edge of the spinning nozzle 33 to the second lower plate 35*b*. The bottom ring plate 30 has an opening 30*a* to expose the spinning nozzle holes 33*a* of the spinning nozzle 33.

The outer wall and the topside of the second lower plate 35*b* and the spinning nozzle 33 are surrounded with the heating body 36 for heating up the portion of the spinning nozzle holes 33*a* of the spinning nozzle 33.

In general, the pack body 31 is maintained at 50 to 350° C. with the pack body heater 32. Undesirably, the temperature of the pack body 31 lower than 50° C. maintains almost the resins hard rather than melted and makes it difficult to spin the resins, and the temperature of the pack body 21 above 350° C. causes a rapid thermal degradation of the resin to deteriorate the properties of the fiber.

It is therefore preferable to maintain the temperature of the spinning nozzle holes 33*a* of the spinning nozzle 33 heated by the heating body 36 higher than that of the pack body 31. For example, the spinning nozzle holes 33*a* of the spinning nozzle 33 are preferably maintained in the temperature range of 350 to 700° C. when the temperature of the pack body 31 is 300° C. Accordingly, the heating temperature for the portion of the spinning nozzle holes 33*a* is higher than that for the melted resin in the pack body 31.

It is desirable to minimize a heat transfer between the pack body 31 and the heating body 36. For this, a space member 37 is provided between the pack body 31 and the heating body 36 to allow the passage of air. Further, the space member 37 makes the male screw member 39 of the second lower plate 25*b* exposed to the outside.

Such a structure prevents a transfer of high heat from the heating body 36 and the second lower plate 25*b* to the pack body 31 and the first lower plate 25*a* and the resulting rise in the temperature of the pack body 31 and the first lower plate 25*a* at once, where the elevation of the temperature may cause a deterioration of the raw material consisting of a thermoplastic resin, for example, polyester-based polymer resin in the pack body 21 and the first lower plate 25*a* and hence deteriorate the properties of the fiber product.

According to the spinning nozzle apparatus of the second embodiment, the melted thermoplastic resin induced into the spinning nozzle 33 installed on the outside of the pack body 31 through the retainer 34 and the lower plate 35 is spun through the spinning nozzle holes 33*a* of the spinning nozzle 33 to form a fiber F. After the spinning process, the fiber F is cooled down and subjected to the drawing and winding processes using a yarn texturing machine to form a high-strength thermoplastic polymer fiber.

In this regard, the heating body 36 instantaneously heats up the spinning nozzle 33 disposed on the outside of the pack body 31 to a temperature above the temperature of the pack body 31 by at least 50 to 400° C., achieving a control of the molecular entanglement structure in the melted polymer being spun through the spinning nozzle holes 33*a* to improve the mechanical properties of the thermoplastic polymer fiber such as strength and elongation.

With such a construction that allows the passage of the external air in the space member 37 between the heating body 36 and the pack body 31 and exposes the male screw member 39 of the second lower plate 35*b* through the space member 37, it is possible to minimize the rise of the temperature caused by a heat transfer from the heating body 36 to the pack body 31 and the second lower plate 35*b* and thus to prevent a deterioration of the properties caused by the deterioration of the melted polymer.

In the spinning nozzle apparatus of the second embodiment, the spinning nozzle 33 is detachable from the second lower plate 35*b*, which makes it easier and faster to replace the spinning nozzle 33 and clean the spinning nozzle holes 33*a* of the spinning nozzle 33 simply by separating the spinning nozzle 33 from the second lower plate 35*b*.

Figure 3A:
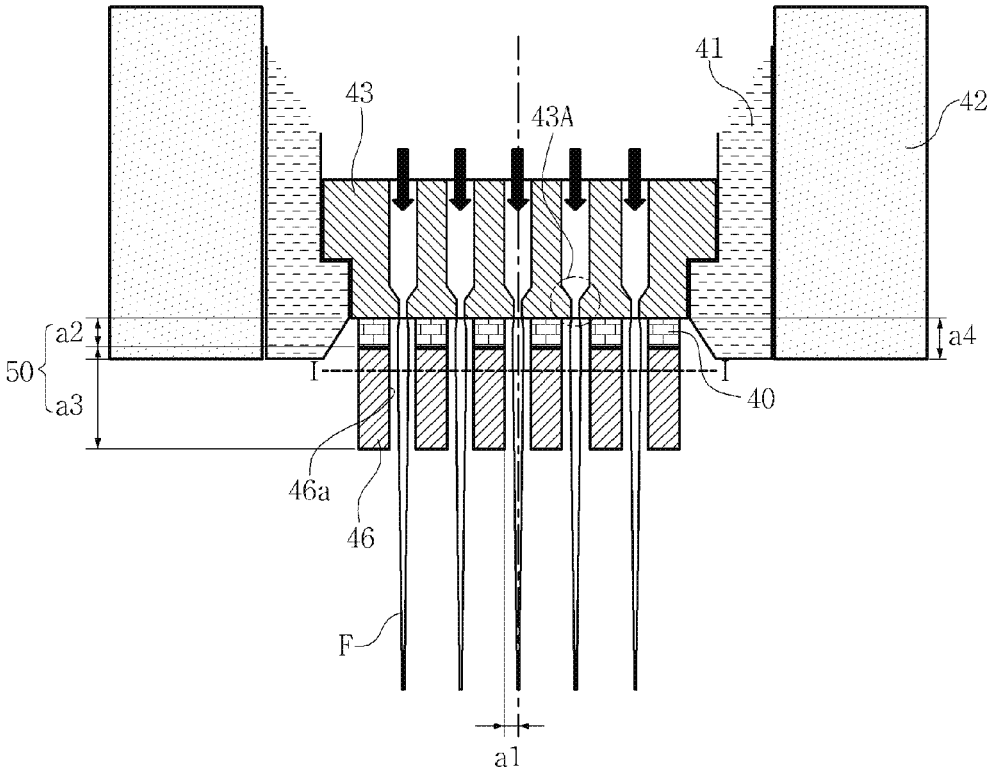
FIG. 3A is a cross-sectional diagram showing a spinning nozzle apparatus for manufacturing a high-strength fiber in accordance with a third embodiment of the present invention.
Figure 3B:
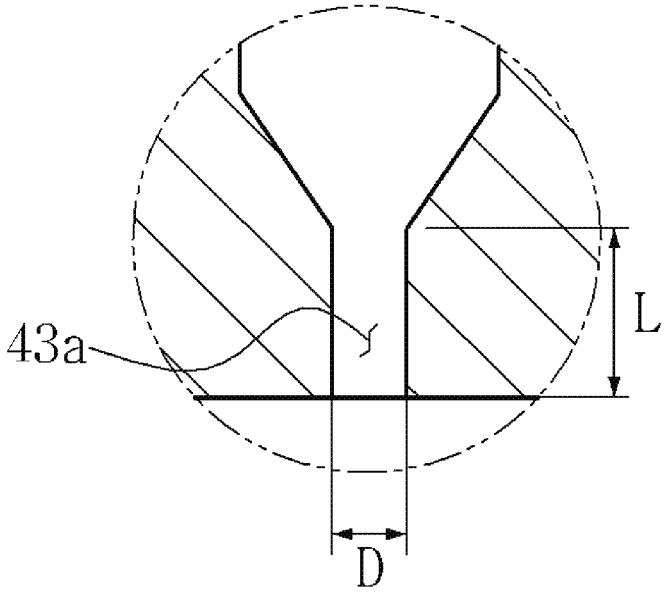
FIG. 3B is a partial enlarged view of 43A in FIG. 3A.

FIG. 3A is an illustration of a spinning nozzle apparatus in accordance with a third embodiment of the present invention. FIG. 3B is a partial enlarged view of 43A in FIG. 3A. As illustrated in the FIGS. 3A and 3B, the spinning nozzle apparatus according to the third embodiment of the present invention includes: a pack body 41; a pack body heater 42 installed on the outside of the pack body 41 to provide a heat source for the pack body 41; a spinning nozzle 43 being installed in the pack body 41 and having a plurality of spinning nozzle holes 43*a* for spinning a melted thermoplastic resin; and a retainer 44 and a lower plate 45 installed in the pack body 41 to feed the melted thermoplastic resin into the spinning nozzle 43.

The spinning nozzle apparatus of the third embodiment further includes: a heating body 46 disposed under the spinning nozzle holes 43*a* of the spinning nozzle 43 to heat up a fiber after a spinning process to a temperature above the temperature of the pack body 41; and an insulating layer 40 disposed between the spinning nozzle 43 and the heating body 46. The heating body 46 has a hole-type heating opening 46*a* or a band-type heating opening 46*b* arranged in a row for the passage of the fiber after the spinning process.

The spinning nozzle 43 spins a melted thermoplastic resin through the spinning nozzle holes 43*a* to form a fiber F. After the spinning process, the fiber F is heated through the heating body, cooled down, and then subjected to the drawing and winding processes using an in-line texturing machine to produce a high-strength thermoplastic polymer fiber.

Figure 4:
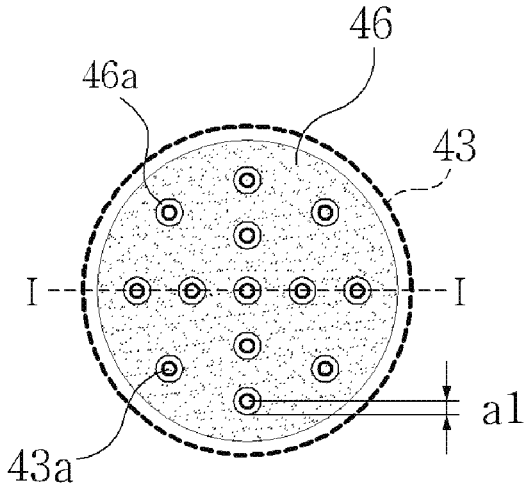
FIG. 4 is a cross-sectional diagram taken as indicated by the line I-I line of FIG. 3A showing a heating body with a hole-type heating opening.

FIG. 4 is a cross-sectional diagram taken by the line I-I of FIG. 3A. In the figure, the heating body 46 has a hole-type heating opening 46*a*, which comes in the same number and structure as the spinning nozzle holes 43*a* of the spinning nozzle 43. After the spinning process, the fibers F are forced to pass through the individual heating openings 46*a*, but not in direct contact (e.g., heat transfer) with the heating openings 46*a* while passing through the heating openings 46*a*.

For this, the distance a1 from the inner circumference of the heating opening 46*a* to the center of the fiber F is preferably 1 to 300 mm, more preferably 1 to 30 mm. The hole-type heating opening 46*a* is capable of maintaining a uniform temperature at a same distance from its center in all directions.

Figure 5:
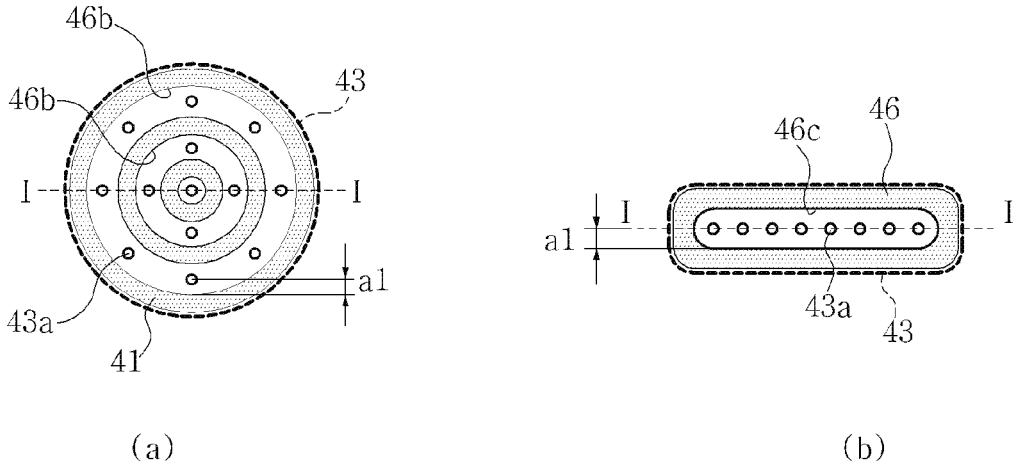
FIG. 5 is a cross-sectional diagram taken as indicated by the line I-I line of FIG. 3A showing a heating body with a circular band-type heating opening (a) or a linear band-type heating opening (b).

A modified example of the heating opening 46*a* is illustrated in FIG. 5, which is a cross-sectional diagram taken by the line I-I of FIG. 3A. For the spinning nozzle with the spinning nozzle holes 43*a* arranged in concentric circle as shown in (a) of FIG. 5, there may be provided a circular band-type heating opening 46*b* so that the fibers F spun from the plural spinning nozzle holes 43*a* arranged in a concentric circle pass through the circular band-type heating opening 46*b* all together. For the spinning nozzle with the spinning nozzle holes 43*a* arranged in a linear line as shown in (b) of FIG. 5, a linear band-type heating opening 46*c* may be provided so that the fibers F spun from the plural spinning nozzle holes 43*a* arranged in a linear line pass through the linear band-type heating opening 46*c* all together. If now shown, the heating body 46 may have a band-type heating opening formed in any shape such as circular arc, unbella shape, or the like according to the arrangement form of the spinning nozzle holes, or a combination of multiple band-type heating openings of different shapes.

Like the hole-type heating opening 46*a*, the band-type heating opening 46*b* is designed so that the distance a1 from the inner circumference of the heating opening 46*b* to the center of the spinning nozzle holes is preferably 1 to 300 mm, more preferably 1 to 30 mm.

Referring to FIGS. 4 and 5 again, it is desirable not to have a heat transfer between the spinning nozzle 43 and the heating body 46. For this, an insulating layer 40 is provided between the spinning nozzle 43 and the heating body 46.

The temperature of the spinning nozzle 43 is the same as that of the pack body heater 41. The insulating layer 40 functions to reduce a heat transfer so that a high-temperature heat generated from the heating body 46 disposed directly under the spinning nozzle 43 is not transferred to the spinning nozzle 43. This can prevent the deterioration of the raw material consisting of a thermoplastic resin such as a polyester-based polymer resin in the spinning nozzle 43 and hence the deterioration of the properties of the fiber. In this regard, the material for the insulating layer 40 may be a known insulating material making an insulating effect, preferably an inorganic high-temperature/fire-resistant insulating material containing a glass- and ceramic-based compound.

The thickness a2 of the insulating layer 40 is preferably in the range of 1 to 30 mm that is the distance between the spinning nozzle 43 and the heating body 46. It is undesirable to have the thickness a2 greater than 30 mm, for example, because the fiber F formed after the spinning process through the spinning nozzle 43 is cooled down before the heat treatment using the heating body 46, which makes it difficult to effectively control the melted structure.

The extension length a3 of the heating body 46 is 1 to 500 mm from the bordering surface with the insulating layer 40. Accordingly, the heating region in which the fiber moves includes the thickness a2 of the insulating layer 40 and the extension length a3 of the heating body 46.

In other words, the heating body 46 of the third embodiment uses an indirect heating (e.g., radiation transfer) for the fiber F after the spinning process in such a way that while the fiber F is passing through the heating body 46, it moves a distance that includes the thickness a2 (1 to 30 mm) of the insulating layer 40 directly under the spinning nozzle 43 and the extension length a3 (1 to 500 mm) of the heating body 46 from the insulating layer 40.

At this time, the distance a4 directly from under the heating body 46 to the bottom surface of the pack body 41 is in the range of 1 to 50 mm so that the whole of the insulating layer 40 and part of the heating body 46 are disposed in the pack body 41. This realizes an indirect heating (e.g., radiation transfer) on all the fibers F immediately after the spinning process to improve the mechanical properties.

The heating region 50 including the heating body 46 and the insulating layer 40 as illustrated in the above-designed third embodiment of the present invention is available directly under the spinning nozzle 43 commercially available without a change of the design, lowering the initial investment cost and realizing a large-quantity production of high-performance fibers at a low cost.

In addition, the third embodiment applies an instantaneous heating on the whole fibers F discharged from the spinning process at high temperature uniformly from a constant distance with the heating body to control the molecular entanglement structure in the melted polymer, thereby the melt viscosity and enhancing the drawability, and uses the insulating layer 40 to prevent a high-temperature heat from being transferred to the spinning nozzle holes 43*a* of the spinning nozzle 43, reducing the deterioration of the properties caused by the deterioration of the melted polymer, improving the strength and elongation of the thermoplastic polymer fiber, and realizing a large-quantity production of high-strength fibers at low cost.

Figure 6A:
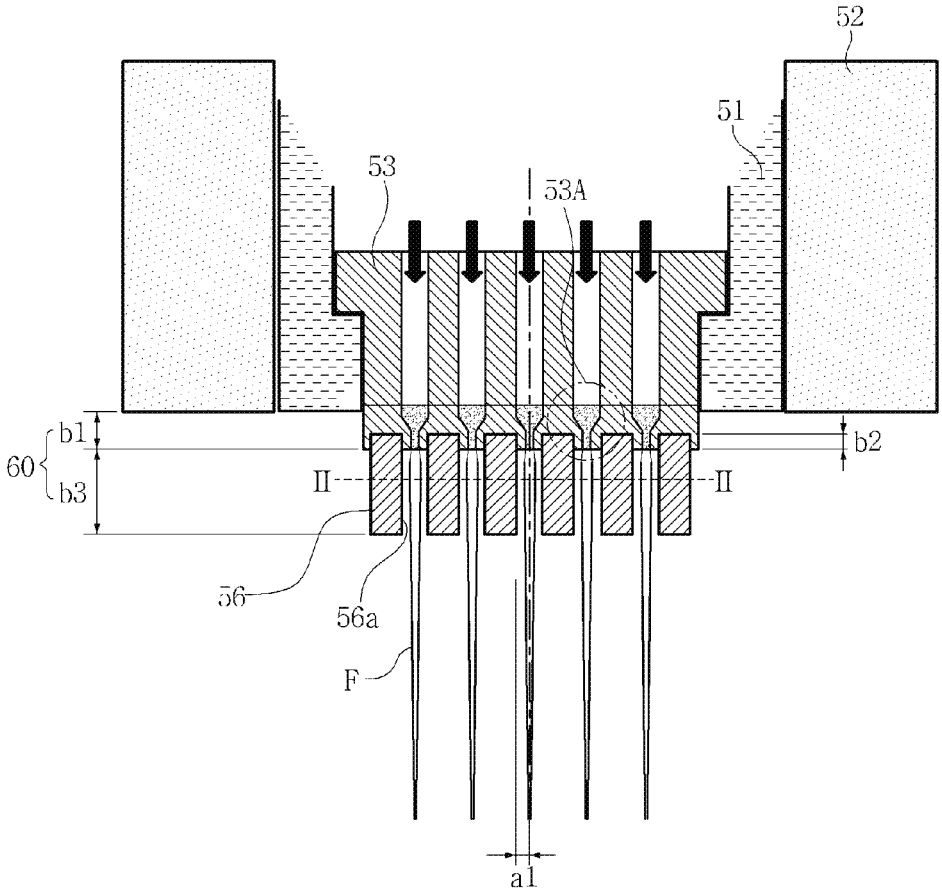
FIG. 6A is a cross-sectional diagram showing a spinning nozzle apparatus for manufacturing a high-strength fiber in accordance with a fourth embodiment of the present invention.
Figure 6B:
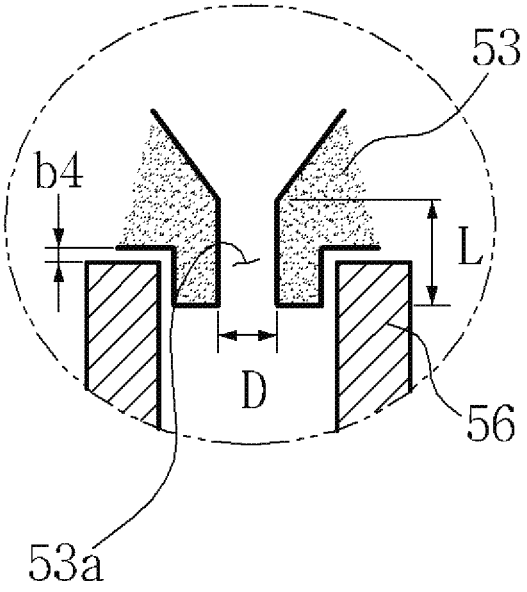
FIG. 6B is a partial enlarged view of 53A in FIG. 6A.
Figure 7:
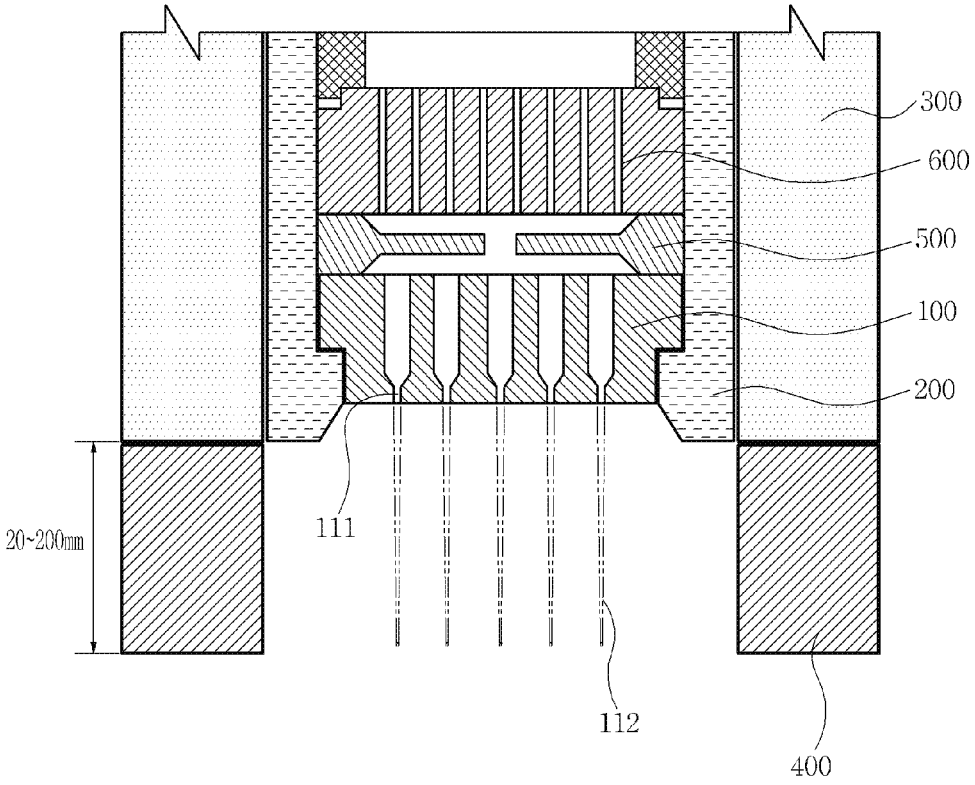
Fig. 7 Prior Art
FIG. 7 is a cross-sectional diagram showing the spinning member of a spinning nozzle apparatus equipped with a spinning nozzle according to an example of the prior art.
Figure 8:
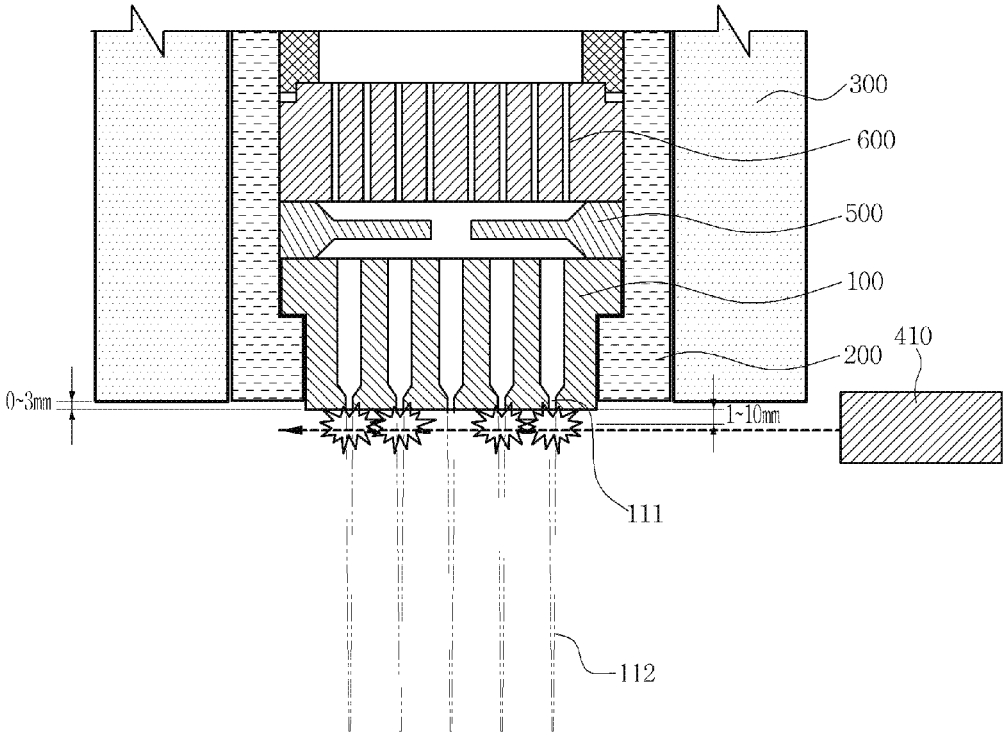
Fig. 8 Prior Art
FIG. 8 is a cross-sectional diagram showing the spinning member of a spinning nozzle apparatus equipped with a spinning nozzle according to another example of the prior art.

FIG. 6A is an illustration of a spinning nozzle apparatus in accordance with a fourth embodiment of the present invention. FIG. 6B is a partial enlarged view of 53A in FIG. 6A. As illustrated in the FIGS. 6A and 6B, the spinning nozzle apparatus according to the fourth embodiment of the present invention includes: a pack body 51; a pack body heater 52 installed on the outside of the pack body to provide a heat source for the pack body; a spinning nozzle 53 being installed in the pack body 51 and having a plurality of spinning nozzle holes 53*a* for spinning a melted thermoplastic resin; and a retainer 54 and a lower plate 55 installed in the pack body to feed the melted thermoplastic resin into the spinning nozzle.

The spinning nozzle apparatus for manufacturing a high-strength fiber according to the fourth embodiment further includes a heating body 56 disposed in the vicinity of the spinning nozzle holes 53*a* of the spinning nozzle 53 to heat up the vicinity of the spinning nozzle holes 53*a* and the spun fiber as well to a temperature above the temperature of the pack body 51. The heating body 56 has a hole-type heating opening 56*a* or a band-type heating opening 56*b* or 56*c* arranged in a row for the passage of the fiber after a spinning process. The heating body 56 is in contact with the bottom of the spinning nozzle 53 or partially inserted in the bottom of the spinning nozzle 53.

In the fourth embodiment, the bottom side of the spinning nozzle 53 is disposed at a distance b1 of 1 to 300 mm from the bottom side of the pack body.

In the fourth embodiment, without an insulating layer right under the spinning nozzle 53, the heating body 56 is in contact with the bottom side of the spinning nozzle 53 or partially inserted in the bottom of the spinning nozzle 53 to an insertion depth b2 of 0 to 50 mm. The heating body 56 extends from the bottom side of the spinning nozzle 53 to an extension length b3 of 0 to 500 mm. Hence, a heating region 60 for the fiber is defined to include the insertion depth b2 of the heating body 56 partially inserted in the bottom of the spinning nozzle 53 and the extension length b3 of the heating body 56 from the bottom side of the spinning nozzle.

As shown in FIG. 6B, the topside of the heating body 56 partially inserted in the bottom of the spinning nozzle 53 has a direct contact with or a gap b4 from the opposing bottom side of the spinning nozzle 53 facing the topside of the heating body 56 so that the heating body 56 is in direct contact with the surface of the nozzle body 52 (gap: 0 mm) or apart from the surface of the nozzle body 52 with the gap of 10 mm to the maximum and heated up in a direct or indirect manner (e.g., heat conduction or radiation transfer), so the melted thermoplastic resin is first heated in the vicinity of the spinning nozzle holes 53*a* of the spinning nozzle in a direct manner (e.g., heat conduction).

Accordingly, the heating region 60 is provided to apply a first direct or indirect heating (e.g., heat conduction or radiation transfer) on the melted thermoplastic resin in the vicinity of the spinning nozzle holes 53*a* in the spinning nozzle 53 prior to the spinning process along the insertion depth b2 of the heating body 56 inserted in the bottom of the spinning nozzle 53 and the gap b4 and then a second indirect heating (e.g., radiation transfer) on the melted fiber F discharged from the nozzle body 52 yet not solidified after the spinning process along the extension length b3 (0 to 500 mm) of the heating body 56 extending from the bottom side of the spinning nozzle 53.

In the heating region 60 of the fourth embodiment, when the heating body 56 is inserted in the bottom of the spinning nozzle 53 to an insertion depth of 50 mm at the maximum, a heat transfer may occur to deteriorate the melted polymer in the spinning nozzle holes 53*a* of the spinning nozzle 53 and hence the properties of the fiber. Taking this problem into consideration, it is preferable to design such that the bottom side of the spinning nozzle 53 is disposed at a distance b1 of 1 to 300 mm from the bottom side of the pack body 51.

Due to the structure modification of the bottom in the spinning nozzle 53 commercially available, the heating region 60 of the fourth embodiment as described above is designed to realize an optimized double-heating thermal transfer method that involves a direct heat transfer to the vicinity of the spinning nozzle holes 53*a* of the spinning nozzle 53 and an indirect heating on the fiber F with the heating body 56 formed right under the spinning nozzle 53, making it possible to control the molecular entanglement structure in the melted polymer caused by the instantaneous heat treatment at high temperature and to enhance the drawability of the final thermoplastic polymer fiber, thereby improving the mechanical properties such as strength and elongation.

Accordingly, the fourth embodiment is modifying the bottom structure of the spinning nozzle 53 commercially available and immediately applicable to reduce the initial investment cost and to realize a large-quantity production of high-performance fibers at a low cost.

In the fourth embodiment, the heating body 56 is partially inserted in the spinning nozzle 53 to heat up the vicinity of the spinning nozzle holes 53*a* of the spinning nozzle 53, reducing the viscosity of the melted resin being spun through the spinning nozzle holes 53*a*, which may enhance the productivity according to the increase in the draw ratio and the spinning speed and enable the spinning of ultrahigh molecular weight resins due to the reduced viscosity of the melted resin particularly in the vicinity of the spinning nozzle holes 53*a* to realize a high strength of the fiber, while the spinning of ultrahigh molecular weight resins is impossible to carry out in the prior art due to high viscosity.

In the fourth embodiment of the present invention, the cross-sectional diagram taken by the line II-II of FIG. 6A shows that the heating openings 56*a*, 56*b* and 56*c* of the heating body 56 are the same as the hole- or band-type heating openings specified in the third embodiment.

More specifically, in the third and fourth embodiments of the present invention, the heating openings 46*a*, 46*b*, 46*c*, 56*a*, 56*b*, and 56*c* are designed to have the same number and structure of the spinning nozzle holes 43*a* and 53*a* of the spinning nozzles 43 and 53, so the fiber F discharged after the spinning process is locally heated while passing through the heating bodies 46 and 56, respectively. In particular, the hole-type heating openings 46*a* and 56*a* have the same structure of the spinning nozzle holes 43*a* and 53*a* of the spinning nozzles 43 and 53. But, their inner circumference is apart from the center of the spinning nozzle holes of the nozzle bodies at a distance of 1 to 300 mm so that it is possible to maintain a uniform temperature at a same distance from the center of the spinning nozzle holes 43*a* and 53*a* of the spinning nozzle 43 and 53 in all directions.

In addition, the band-type heating openings 46*b* and 56*b* have a linear structure with the halves almost exactly opposite one another, 180° apart on the spinning nozzle holes 43*a* and 53*a* of the spinning nozzles 43 and 53 and symmetric to each other at a distance of 1 to 300 mm from the center of the spinning nozzle holes 43*a* and 53*a*.

In this regard, it is designed to realize an indirect heating method that the fiber F is not in direct contact with the heating openings 46*a*, 46*b*, 46*c*, 56*a*, 56*b*, and 56*c* while passing through the heating openings after the spinning process. When the heating openings 46*a*, 46*b*, 46*c*, 56*a*, 56*b*, and 56*c* are large in size and apart from the spinning nozzle holes 43*a* and 53*a* of the spinning nozzles 43 and 53 at a distance less than 1 mm, it is highly likely to have the heating bodies 46 and 56 in contact with the fiber F, possibly causing contamination of the heating bodies 46 and 56 or the breakage of the fiber F to deteriorate the fiber quality and the workability and a risk of deteriorating the fiber F due to the exposure to excessive heat. When the distance between the heating openings 46*a*, 46*b*, 46*c*, 56*a*, 56*b*, and 56*c* and the spinning nozzle holes 43*a* and 53*a* of the spinning nozzles 43 and 53 is greater than 300 mm, a heat transfer to the fiber F is too insufficient to control the molecular entanglement structure in the melted polymer, undesirably reducing the effect of improving the properties.

When it comes to the structure of the spinning nozzle holes 43*a* and 53*a* of the spinning nozzle 43 and 53, as illustrated in FIGS. 4 and 6, the orifice diameter D is 0.01 to 5 mm; the orifice length L is at least L/D 1; and the number of the orifices 11 and 51 in the nozzle bodies is at least one.

The pitch between the spinning nozzle holes 43*a* and 53*a* is at least 1 mm, and the cross-sectional shape of the spinning nozzle holes 43*a* and 53*a* is a circle as illustrated in the embodiments of the present invention but may also include any non-circular shape (e.g., Y, +, −, O, etc.). Further, a combination of at least two spinning methods such as sheath-core type, side-by-side type, sea island type, or the like may be available using a spinneret including spinning nozzles 10 and 50.

In the third and fourth embodiments of the present invention, the hole-type heating openings 46*a* and 56*a* of the heating bodies 46 and 56 are the same in the structure and the number as the spinning nozzle holes 43*a* and 53*a* of the spinning nozzles 43 and 53, so the opening structure may take any shape including circle, oval, rectangle, donut, etc.

In the spinning nozzle devices for manufacturing a high-strength fiber according to the first to fourth embodiments as described above, the temperature of the heating bodies 26, 36, 46, and 56 may be regulated with a general electric heat ray or a general heat medium in the same manner as that of the pack body heaters 22, 32, 42, and 52. Specific examples of the electric heat ray may include any one selected from a Cu— or Al-based cast heater, an electromagnetic induction heater, a near-infrared heater, a carbon heater, a ceramic heater, a PTC heater, a quartz tube heater, a halogen heater, and so forth.

The use of the spinning nozzle devices for manufacturing a high-strength fiber according to the first to fourth embodiments as described above in the production of a fiber F may be applied to any general thermoplastic resin, more preferably to any polymer resin vulnerable to heat. Moreover, the present invention is applicable to any spinning nozzle apparatus commercially available just with a minimum modification of the design, reducing the initial investment cost and realizing a large-quantity production of high-performance fibers at a low cost.

Specific examples of the thermoplastic resin as used herein may include nylon-, PP- or PE-based polymers as well as polyester-based polymers (e.g., PET (Polyethylene terephthalate), PBT (Polybutylene terephthalate), PTT (Polytrimethylene Terephthalate), PEN (Polyethylene naphthalate), etc.). The embodiments of the present invention are most preferably applicable to the production of polyester-based fibers. But they may also be applicable to the textile applications including PET long fibers and short fibers, unwoven fabrics, etc. and even to the manufacture of films, sheets, molds, containers, or the like using those textile materials.

In the spinning nozzle devices for manufacturing a high-strength fiber according to the first to fourth embodiments, in order to achieve the same object, it is necessary to optimize the retention time, flux, and shear rate of the melted polymer passing through the spinning nozzle holes 23*a*, 33*a*, 43*a*, and 53*a* of the spinning nozzles 23, 33, 43, and 53.

Preferably, the retention time of the melted polymer through the spinning nozzle holes 23*a*, 33*a*, 43*a* and 53*a* is 3 seconds or less, and the flux is at least 0.01 cc/min. In the case of the polyester-based polymers, the retention time exceeding 3 seconds may cause a deterioration of the melted polymer in terms of workability and further a deterioration of the fiber F due to the exposure to an excessive heat; and the flux less than 0.01 cc/min leads to an insufficient heat transfer to the fiber F, making it difficult to control the molecular entanglement structure in the melted polymer and undesirably reducing the effect of improving the properties.

In the spinning nozzle devices of the first to fourth embodiments, the shear rate on the wall surface of the spinning nozzle holes 23*a*, 33*a*, 43*a*, and 53*a* of the spinning nozzles 23, 33, 43, and 53 is preferably 500 to 500,000/sec. A low shear rate less than 500/sec reduces the effect of controlling the molecular orientation and structure of the melted polymer; and a high shear rate greater than 500,000/sec causes the defective appearance of the film (e.g., melt fracture) due to the viscoelasticity of the melted polymer and eventually an uneven cross-section of the fiber.

The spinning nozzle devices of the first to fourth embodiments are applicable to the melt spinning process using at least one thermoplastic polymer as a raw material. More specifically, the spinning nozzle devices may be applied to a single or composite monofilament spinning process to produce monofilaments having a diameter of 0.01 to 3 mm at a spinning rate of 0.1 to 200 m/min.

The spinning nozzle devices of the first to fourth embodiments are also applicable to a single or composite long fiber spinning process for fibers F of 100 d/f or less (long fibers) using a low rate spinning method (UDY, 100 to 2,000 m/min), a medium-and-low rate spinning method (POY, 2,000 to 4,000 m/min) and a high rate spinning method (HOY, 4,000 m/min or above), and a spinning and in-line drawing process (SDY) in the composite melt spinning process.

The spinning nozzle devices are also applicable to a single or composite staple fiber (short fiber) spinning process to produce a fiber having a diameter of 100 d/f or less at a spinning rate of 100 to 3,000 m/min, or a single or composite unwoven fabric (spun-bond and melt blown) spinning process to yield a unwoven fabric having a diameter of 100 d/f or less at a spinning rate of 100 to 6,000 m/min. In addition, the spinning nozzle devices may be applied to the polymer resin molding and extrusion process or the like.

As described above, the spinning nozzle apparatus of the present invention improves the properties of fibers by utilizing the existing design of the spinning nozzle devices commercially available and the existing processes for melt spinning and drawing, thereby reducing the initial investment cost and realizing a large-quantity production of high-performance fibers at a low cost.

Accordingly, the present invention is available in the tire cords, the interior materials for transportation including automobile, trains, aircrafts, ships, etc., civil engineering and construction materials, electronic materials, marine and military applications such as ropes and nets, and other clothing and household applications, including light-weighted sportswear and work clothes, military uniforms, furniture and interior materials, sports equipment, or the like, so it may expand the market for the wider range of applications.

BEST MODES FOR CARRYING OUT THE INVENTION

<Examples 1 and 2> Preparation of High-Strength Pet Fiber Using Spinning Nozzle Apparatus of First Embodiment A local heating method using the spinning nozzle apparatus of the first embodiment was performed with the intrinsic viscosity of the PET resin varied as given in Table 1, and low-rate spinning and off-line drawing were performed under the following conditions to prepare high-strength PET fibers.

(1) Spinning Conditions

Resin: Example 1: PET (I.V. 0.65), Example 2: PET (I.V. 1.20)

Spinning temperature (nozzle temperature): 280300° C.

Diameter of spinning nozzle orifice: Ø0.5

Throughput rate per spinning nozzle orifice: 3.3 g/min

Temperature of nozzle-based local heater: pack body temperature+100° C. or above Spinning velocity: 1 km/min (2) Off-Line Drawing Conditions Undrawn yarn: PET as-spun fiber obtained under the above-defined spinning conditions 1st godet roll speed (temperature): 10 m/min (85° C.)

The number of drawing stages: at least 3

Sampling of drawn yarn obtained at maximum draw ratio available for continuous drawing without yarn breakage (heat-set temperature: 130~180° C.)

TABLE 1

Low speed spinning and off-line drawing of PET fiber (Prior art versus novel spinning nozzle apparatus Type-1)

| Div. | | | Example 1 | Example 2 | Comparative Example 1 | Comparative Example 2 |
|---|---|---|---|---|---|---|
| Nozzle-based local heating temperature | | | Type-1 (pack body temperature + 100° C.) | | n/a (Same as pack body temperature) | |
| Intrinsic viscosity (I.V.) (dl/g) of PET resin | | | 0.65 | 1.2 | 0.65 | 1.2 |
| Properties (PET)(1) | As-spun fiber (Undrawn Yarn) (2) | Strength (g/d) | 2 | 1.9 | 2 | 1.8 |
| | | Elongation (%) | 535.7 | 551.2 | 498.5 | 454.6 |
| | Drawn yarn(3) | Strength (g/d) | 6.69 | 13.2 | 5.8 | 10.2 |
| | | Elongation (%) | 18.2 | 12.3 | 18.9 | 12.8 |
| Maximum draw ratio(4) | | | 4.5 | 5.3 | 4 | 4.5 |

Note:
(1)Measurement conditions: Gauge length 20 mm & test speed 20 mm/min
(2) Spinning rate: 1 km/min
(3), (4)Drawn yarn obtained at maximum draw ratio available for continuous drawing for at least 10 min.

Property analyses concerning strength and elongation were performed to evaluate the fibers of Examples 1 and 2 as prepared from PET resins having an intrinsic viscosity of 0.65 or 1.2 using a nozzle-based local heating process with the spinning nozzle apparatus according to the first embodiment of the present invention and the fibers of Comparative Examples 1 and 2 as prepared in the same manner excepting that the nozzle-based local heating method was not used (instead, using the same temperature of the pack body temperature). As can be seen from Table 1, the undrawn yarn (as-spun yarn) and the drawn yarn prepared in the Examples 1 and 2 were superior in the properties to those prepared in the Comparative Examples 1 and 2 in the same manner as the Examples 1 and 2 excepting that the nozzle-based local heating process was not performed. The analysis results showed that the low and high molecular PET resins were both enhanced in the properties due to the control of the molecular entanglement structure according to the nozzle-based local heating process.

Particularly, for the drawn yarns of the Examples 1 and 2, as compared with the conventional PET fibers of the Comparative Examples 1 and 2, both the high and low molecular PET fibers had a higher maximum draw ratio by 10% or greater and a roughly equivalent elongation, but with the strength increased by 15% or above.

<Examples 3 and 4> Preparation of High-Strength Pet Fiber Using Spinning Nozzle Apparatus of Second Embodiment A local heating method using the spinning nozzle apparatus of the second embodiment was performed with the local heating temperature varied as given in Table 2, and low-rate spinning and off-line drawing were performed under the following conditions to prepare high-strength PET fibers.

(1) Spinning Conditions
Resin: PET (I.V. 1.20)
Spinning temperature (nozzle temperature): 280~300° C.
Diameter of spinning nozzle orifice: Ø0.5
Discharge per spinning nozzle orifice: 3.3 g/min
Temperature of nozzle-based local heater: pack body temperature+100~150° C. or above
Spinning rate: 1 km/min
(2) Off-Line Drawing Conditions
Undrawn yarn: PET as-spun fiber obtained under the above-defined spinning conditions
1st godet roll speed (temperature): 10 m/min (85° C.)
The number of drawing stages: at least 3
Sampling of drawn yarn obtained at maximum draw ratio available for continuous drawing without yarn breakage (heat-set temperature: 130-180° C.)

TABLE 2

Low-rate spinning and off-line drawing of PET fiber (Prior art versus novel spinning nozzle apparatus Type-2)

| Div. | | | Example 3 | Example 4 | Comparative Example 3 |
|---|---|---|---|---|---|
| Nozzle-based local heating temperature | | | Pack body temperature + 100° C. | Pack body temperature + 150° C. | Same as pack body temperature |
| Intrinsic viscosity (I.V.) (dl/g) of PET resin | | | 1.2 | 1.2 | 1.2 |
| Properties (PET)(1) | As-spun fiber (Undrawn Yarn) (2) | Strength (g/d) | 1.9 | 2.1 | 1.8 |
| | | Elongation (%) | 545.2 | 585.7 | 460.1 |
| | Drawn yarn(3) | Strength (g/d) | 12.8 | 14.2 | 10.3 |
| | | Elongation (%) | 13.1 | 12.8 | 12.9 |
| Maximum draw ratio(4) | | | 5.3 | 5.6 | 4.5 |

Note:
(1)Measurement conditions: Gauge length 20 mm & test speed 20 mm/min
(2) Spinning rate: 1 km/min
(3), (4)Drawn yarn obtained at maximum draw ratio available for continuous drawing for at least 10 min.

Property analyses concerning strength and elongation were performed to evaluate the fibers of Examples 1 and 2 as prepared from PET resins having an intrinsic viscosity of 1.2 by varying the heating temperature using a nozzle-based local heating process with the spinning nozzle apparatus according to the second embodiment of the present invention and the fiber of Comparative Example 3 as prepared in the same manner excepting that the nozzle-based local heating method was not used (instead, using the same temperature of the pack body temperature). As can be seen from Table 2, the undrawn yarn (as-spun yarn) and the drawn yarn prepared in the Examples 3 and 4 were superior in the properties to the fiber prepared in the Comparative Example 3 in the same manner as the Examples 3 and 4 excepting that the nozzle-based local heating process was not performed. The property values of the fibers increased with an increase in the heating temperature of the local heating process. The analysis results showed that the high molecular PET resin was enhanced in the properties due to the control of the molecular entanglement structure according to the nozzle-based local heating process. Particularly, as the property values increased with an increase in the heating temperature, it is expected that the properties can be more improved by further increasing the heating temperature.

As compared with the conventional PET fiber of the Comparative Example 3, both the drawn PET fibers of the Examples 3 and 4 had a higher maximum draw ratio by 15% or greater and a roughly equivalent elongation, but with the strength increased by 20% or above.

<Example 5> Preparation of High-Strength Pet Fiber Using Spinning Nozzle Apparatus of Third Embodiment A local heating method using the spinning nozzle apparatus of the third embodiment was performed under the following conditions to prepare a high-strength PET fiber.

(1) Spinning Conditions
Resin: PET (I.V. 1.21)
Spinning temperature (nozzle temperature): 300° C.
Discharge per spinning nozzle orifice: 4 g/min
Spinning rate: 1 km/min
Temperature of heating body: 400° C. or above
(2) Property Analysis Results Compared to the PET fiber obtained with the heating body 46 OFF and having a strength of 230 MPa and an elongation of 435%, the PET fiber obtained with the heating body 46 ON displayed a strength of 231 MPa and an elongation of 455%; namely, the strength was roughly equivalent, but the elongation was increased by 4.6% to elevate the toughness.

<Example 6> Preparation of High-Strength Pet Fiber Using Spinning Nozzle Apparatus of Fourth Embodiment A local heating method using the spinning nozzle apparatus of the fourth embodiment was performed under the following conditions to prepare a high-strength PET fiber.

(1) Spinning Conditions
Resin: PET (I.V. 1.21)
Spinning temperature (nozzle temperature): 300° C.
Discharge per spinning nozzle orifice: 4 g/min
Spinning rate: 1 km/min
Temperature of heating body: 400° C. or above
(2) Property Analysis Results
Compared to the PET fiber obtained with the heating body 56 OFF and having a strength of 210 MPa and an elongation of 485%, the PET fiber obtained with the heating body 56 ON displayed a strength of 211 MPa and an elongation of 520%; namely, the strength was roughly equivalent, but the elongation was increased by 7.2% to elevate the toughness.

<Example 7> Preparation of High-Strength Pet Fiber Using Spinning Nozzle Apparatus of Fourth Embodiment A local heating method using the spinning nozzle apparatus of the fourth embodiment was performed in the same manner as described in Example 6, excepting that an in-line drawing process was performed immediately after a low-rate spinning process under the following conditions, to prepare a PET fiber.

(1) Spinning and High-Rate in-Line Drawing Conditions
Nozzle body temperature: 300° C.
Discharge per spinning nozzle orifice: 4 g/min
Temperature of heating body: 400° C. or above
$1^{st}$ roll speed and temperature: 1,000 m/min and 85° C.
$2^{nd}$ roll speed and temperature: 4,000 m/min and 130° C.
Winding speed: 3,960 m/min
(2) Property Analysis Results
Compared to the PET fiber obtained with the heating body 56 OFF and having a strength of 1,180 MPa and an elongation of 11.0%, the PET fiber obtained with the heating body 56 ON displayed a strength of 1,175 MPa and an elongation of 13.8%; namely, the strength was roughly equivalent, but the elongation was increased by 25% to elevate the toughness.

INDUSTRIAL APPLICABILITY

As described above, the spinning nozzle apparatus for manufacturing a high-strength fiber according to the present invention is designed to position the spinning nozzle holes of spinning nozzles on the outside of the pack body in the complex melt spinning process and to optimize a heating method for the portion of the spinning nozzle holes, so it can control the molecular entanglement structure in the melted polymer by applying an instantaneous heat treatment at high temperature to enhance the drawability of thermoplastic polymer fibers and hence improve the mechanical properties such as strength and elongation.

The spinning nozzle apparatus for manufacturing a high-strength fiber according to the present invention adopts the existing processes for melt spinning and drawing but makes an effect to reduce the melt viscosity of the resins, lower the cooling rate of the fibers and improve the drawability of the fibers, resulting in reducing the initial investment cost and realizing a large-quantity production of high-performance fibers at a low cost.

By providing high-strength polyester fibers out of thermoplastic polymers, the spinning nozzle apparatus of the present invention is available to the production of tire cords, interior materials for transportation including automobile, trains, aircrafts, ships, etc., civil engineering and construction materials, electronic materials, marine and military applications such as ropes and nets, and other clothing and household applications, including light-weighted sportswear and work clothes, military uniforms, furniture and interior materials, sports equipment, or the like, and hence promising market expansion for the wider range of applications.

Particularly, by providing high-strength PET fibers, the spinning nozzle apparatus of the present invention is applicable to the production of textile applications including PET long and short fibers, unwoven fabrics, etc., and films, sheets, molds, containers, or the like using those textile materials.

Although the exemplary embodiments of the present invention have been described, it is understood that the present invention should not be limited to these exemplary embodiments but various changes and modifications can be made by one ordinary skilled in the art within the spirit and scope of the present invention as hereinafter claimed.

What is claimed is:

1. A spinning nozzle apparatus for manufacturing a high-strength fiber, comprising:
a pack body (21);
a pack body heater (22) installed on an outside of the pack body to provide a heat source for the pack body;
a spinning nozzle (23) installed in the pack body (21) to spin a melted thermoplastic resin; and
a retainer (24) and a lower plate (25) installed in the pack body (21) to feed the melted thermoplastic resin into the spinning nozzle (23),
the spinning nozzle (23) comprising a fixation member (23*b*) disposed on an inside of the pack body (21) and a spinning member (23*c*) disposed on the outside of the pack body (21),
wherein the spinning member (23*c*) disposed on the outside of the pack body has a plurality of spinning nozzle holes (23*a*) for melt-spinning the thermoplastic resin to form a fiber,
the spinning nozzle apparatus further comprising:
a heating body (26) for heating a portion of the spinning nozzle holes (23*a*) of the spinning member (23*c*) to a temperature above a temperature of the pack body (21),
wherein the spinning nozzle (23) has an extension member (23*d*) for maintaining the spinning member (23*c*) apart from the fixation member (23*b*),
wherein the spinning nozzle apparatus further comprises a space member (27) between an inner wall of the fixation member (23*b*) and the extension member (23*d*) and an opposing outer wall of the lower plate (25), and an air passage hole (28) formed in the extension member (23*d*) to provide a connection between the space member (27) and the outside.

2. The spinning nozzle apparatus for manufacturing a high-strength fiber as claimed in claim 1, wherein the extension member (23*d*) extends to a length of 10 to 500 mm from a bottom of the pack body (21) to position the spinning nozzle holes (23*a*) of the spinning member (23*c*).

3. The spinning nozzle apparatus for manufacturing a high-strength fiber as claimed in claim 1, wherein the heating body (26) is installed in a ring form to surround a side wall of the spinning member (23*c*).

4. The spinning nozzle apparatus for manufacturing a high-strength fiber as claimed in claim 1, wherein a bottom of the lower plate (25) is inserted in the spinning nozzle (23) and is extended to a boundary point between the extension member (23*d*) and the spinning member (23*c*) of the spinning nozzle (23) to induce the melted thermoplastic resin to an inlet of the spinning nozzle holes (23*a*).

* * * * *